US006073693A

United States Patent [19]

Aldridge

[11] Patent Number: 6,073,693

[45] Date of Patent: Jun. 13, 2000

[54] DOWNHOLE ANCHOR

[75] Inventor: Colin A. Aldridge, Okotoks, Canada

[73] Assignee: Ipec Ltd., Calgary, Canada

[21] Appl. No.: 08/826,969

[22] Filed: Apr. 9, 1997

[30] Foreign Application Priority Data

May 30, 1996 [CA] Canada ..... 2177762

[51] Int. Cl.[7] ..... E21B 23/04

[52] U.S. Cl. ..... 166/217

[58] Field of Search ..... 166/216, 68.5, 166/187, 217, 242.1

[56] References Cited

U.S. PATENT DOCUMENTS

| | | | |
|---|---|---|---|
| 1,674,798 | 6/1928 | Reed . | |
| 2,304,330 | 12/1942 | Bannister . | |
| 2,665,888 | 1/1954 | Claypool . | |
| 3,167,128 | 1/1965 | Sutcliff | 166/216 |
| 3,211,233 | 10/1965 | Brown | 166/216 |
| 3,705,624 | 12/1972 | Pitts | 166/216 |
| 3,710,866 | 1/1973 | Pitts | 166/216 |
| 3,779,314 | 12/1973 | Read | 166/216 |
| 3,912,006 | 10/1975 | Nutter | 166/216 |
| 4,702,313 | 10/1987 | Greenlee et al. | 166/216 |
| 4,750,559 | 6/1988 | Greenlee | 166/216 |
| 4,811,785 | 3/1989 | Weber | 166/242 |
| 4,844,154 | 7/1989 | Ross et al. | 166/139 |
| 4,901,793 | 2/1990 | Weber | 166/68.5 |
| 5,086,839 | 2/1992 | Setterberg | 166/138 |
| 5,148,866 | 9/1992 | Greenlee | 166/134 |
| 5,275,239 | 1/1994 | Obrejanu | 166/210 |
| 5,623,991 | 4/1997 | Jani | 166/216 |
| 5,636,690 | 6/1997 | Garay | 166/216 |

FOREIGN PATENT DOCUMENTS

| | | | |
|---|---|---|---|
| 1180594 | 1/1985 | Canada | F04D 3/02 |
| 1274470 | 9/1990 | Canada | E21B 223/00 |

*Primary Examiner*—Frank Tsay
*Attorney, Agent, or Firm*—Bennett Jones

[57] ABSTRACT

A downhole anchor for preventing rotational movement of a member within a well has a central tubular member, a slip housing and a drag assembly disposed about the tubular member. The slip housing carries at least two slip members, each slip member being rotatable about an axis substantially parallel to the central axis of the tubular member between a retracted position, against the housing, and an extended position. The drag assembly is mounted on and rotatable about the tubular member and carries drag means. An actuator drives the rotation of the slip member in response to the rotation of the drag assembly about the tubular member. Drag means comprise a spring loaded drag block to frictionally engage a well casing, or, alternatively, unique vane members for reacting with a viscous fluid trapped between the vane members and well casing to cause drag.

28 Claims, 5 Drawing Sheets

DOWNHOLE ANCHOR

FIELD OF THE INVENTION

The present invention relates to an anchor which prevents rotation of a member, such as a tubing string, within a well.

BACKGROUND OF THE INVENTION

The drive rods of progressive cavity pumps, also known as screw-type pumps, tend to impart torque to the pump during operation. This torque causes both the pump and the tubing string to rotate in a right hand direction, when viewed from the top. Such rotation is detrimental to the pumping operation.

An anchor is known for use with a progressive cavity pump and is described in Canadian Patent no.1,274,470 issued Sep. 25, 1990 to Weber. This anchor has a drag assembly and a slip assembly disposed about a central tubular member though which the well fluids can pass. The drag assembly carries a drag means, such as spring-biased drag blocks or belly-type springs, and is free to rotate relative to the tubular member. The slip assembly is formed about the tubular member in engagement with the drag assembly. The slip assembly houses slip members having casing engaging surfaces, which are driven between a retracted position and an extended engaging position by action of the drag and slip assemblies rotating about the central tubular member and slip members moving over the surface of the tubular member where it is formed as a mandrel.

Another anchor is described in U.S. Pat. No. 5,275,239 issued Jan. 4, 1994 to Obrejanu. This anchor has a slip assembly housing slip members which are formed to engage the casing when the anchor is rotated in a predefined direction.

These anchors are quite complex and require the use of springs to drive the slip members. The springs are subject to failure and displacement which limits the useful life of each of the anchors. Additionally, the slip members of these anchors always extend out past the surface curvature of the slip housing and are subject to wear when they come into contact with the casing wall during anchor placement and retrieval. It is difficult to remove the slips from the housings in these anchors which makes them very difficult to refurbish and/or repair.

SUMMARY OF THE INVENTION

An anchor for use with a progressive cavity pump has been invented which eliminates spring-biased slip members. In one embodiment, the slip members of the anchor can be driven into a retracted position so that they do not come into contact with the casing during anchor placement or retrieval.

In accordance with a broad aspect of the present invention, there is provided a downhole tool for preventing rotational movement of a member within a well comprising an elongate tubular member having a central axis; a slip housing disposed about the tubular member and carrying at least two slip members, the slip members each being rotatable about an axis substantially parallel to the central axis of the tubular member between a retracted position, against the housing, and an extended position; a drag housing carrying drag means and being mounted on and rotatable about the tubular member; and an actuator to drive the rotation of the slip members in response to the rotation of the tubular member within the drag housing.

DESCRIPTION OF THE INVENTION

The invention provides an anchor for use in preventing the rotation of a downhole member such as a pump or a tubing string, within a well. The anchor is positionable within the well about the member to be anchored. It is particularly useful to act against a stationary well structure, such as the well casing, to prevent vibration of a progressive cavity pump which produces torque in a right hand direction during use.

The anchor preferably has a central tube segment which is attachable to a pump or which can be inserted in-line into a production tubing string. The tube segment has a hollow bore along its central axis for the passage of production fluids, such as oil and water, and ends suitably adapted, such as by threading, for connection to other tube members or pumps. The outer surface of the tube segment supports a drag assembly and a slip assembly. The drag assembly includes a drag housing which carries a suitable number of drag means. As an example, the drag means can introduce drag between the drag means and the well casing through either frictional or viscous action.

Frictional drag action can be accomplished by outwardly spring-biased drag blocks or belly-type springs provided in the drag assembly. For frictional action, at least two drag means are preferred so that the tube segment is approximately centred in the casing and is not squeezed against one arc of the casing. The drag assembly preferably has three drag means equidistantly spaced about the perimeter, the drag means comprising, for example, three belly springs spaced equally on the drag assembly. The drag means act to engage the well casing frictionally when the anchor is placed in the well. The frictional engagement between the drag means and the well casing is selected so that it can be overcome by application of a reasonable amount of force, but so that it will maintain the positioning of the drag assembly during application of the degree of torque which is applied during operation of a progressive cavity pump.

For viscous drag action, the drag assembly has at least two, and preferably three drag means, each drag means comprising vanes dimensioned to be slidably received in the well casing with each vane defining a vane surface in close proximity to the well casing. In combination with fluids found in the well, such as water or hydrocarbons which are to be pumped from the well, the vanes, well casing and viscous fluid interact to introduce viscous drag upon rotation of the drag assembly in relation to the well casing during set-up of the well anchor of the present invention. The vanes are preferably generally radially displaced about the circumference of the drag means to ensure that sufficient annular space remains to allow fluid flow for pumping.

The drag assembly is preferably mounted on the tubular member in such a way that it can rotate about the central axis of the tubular member. In one embodiment, the drag housing engages an annular flange formed about the tubular member. In another embodiment, a plurality of slots is formed about the circumference of the drag housing though which fasteners, such as bolts, are inserted to engage the tube. The fasteners can slide within the slots to permit a degree of rotation of the assembly about the tube.

The slip assembly includes a housing which can be separate from the tube segment or formed integral therewith. The housing carries at least two slip members. In a preferred embodiment, three slip members are spaced equally about the circumference of the housing. The slip members are pivotally mounted to the housing in any suitable way, such that they are free to rotate about an axis which is substantially parallel to the central axis of the tube. The slip members rotate between a retracted position, in which they are folded against the surface of the housing, and an extended position, in which they extend out from the housing and tube. In a preferred embodiment, all of the slip members rotate from the retracted position to the extended position in the same direction. In this embodiment, the anchor is useful to anchor a well member against rotation in a direction opposite to the direction in which the slip members rotate from the retracted position to the extended position.

The slip housing preferably has formed thereon a contact area for each slip member on which the slip member seats when in the anchoring position. In one embodiment, the slip members are disposed in recesses formed in the slip housing such that when they are in the retracted position they remain below the plane of the surface of the housing. In this embodiment, the contact areas are formed in the recesses and the outer edges of the slip members extend beyond the surface curvature of the housing when in the extended position. In a preferred embodiment, the contact area is formed to substantially conform to the shape of the base of the slip member to provide a broad surface area contact therebetween.

The outer edges of the slip members are preferably formed to enhance their engagement against surfaces such as casing steel. For example, the edge of the slip members can be formed with sharpened serrations.

An actuator is disposed between the drag assembly and the slip assembly. The actuator drives the rotation of the slip members about their axis of rotation in response to rotation of the drag means relative to the tube segment. The actuator can be any suitable arrangement for communicating the relative rotation of the drag means to the slip members. In one embodiment, one actuator is provided for each slip member. A suitable actuator can be, for example, a pair of protrusions which extend out from the edge of the drag assembly to contact opposing surfaces of a slip member. Rotation of the drag assembly moves the protrusions which push the slip member. In another embodiment, the actuator is a pin extending from the slip member which is engaged and driven by the drag assembly. The pin can be, for example, a gear-like arrangement which meshes with and is driven by a toothed portion on the drag housing. In a preferred embodiment, the pin extends from an end of the slip member and is offset from the axis of rotation of the slip member and extends into a groove formed in the end face of the drag housing. The groove extends on the end face from a first position, adjacent the outer diameter, to a second position, circumferentially spaced from the first position and adjacent the inner diameter of the end face.

In use, the anchor is placed to prevent rotation of a member, such as a section of tubing, against rotation in a preselected direction. The anchor is placed in the well such that the tube segment is in communication with the member to be anchored. For example, the tube segment can be inserted into the tubing string. The anchor is further positioned such that the drag assembly is dragging against the well casing. For frictional drag means drag assemblies, the drag means are in contact with and frictionally engage the casing by biased contact with the well casing. For viscous drag means drag assemblies, the drag means are lowered into the well casing until the drag assembly becomes surrounded by fluid such that proximate positioning of the outer surface of the drag means to the well casing causes dragging engagement of the drag means to the well casing through the intermediary of the viscous fluid present in the well. The slip members are in position to rotate from the retracted position to the extended position in a direction which is opposite to the direction of rotation of the tubing string to be anchored. When torque is communicated to the tube segment of the anchor, the tube will rotate within the drag assembly, which is prevented from rotating by means of the dragging engagement of the drag means with the casing. This rotation of the tube within the drag assembly, causes the actuator to drive the slip members from the retracted position, which they are in during anchor placement, to the extended position whereby the slip members engage against the casing wall. Upon engaging the casing wall, the slip members wedge between the contact area of the tube segment and the casing wall to anchor the tube segment against further rotation. This then prevents further rotation of the attached tubing string.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIGS. 5A and 5B are schematic views of slip members wedging between the tubing segment and the casing wall;

DESCRIPTION OF THE PREFERRED EMBODIMENTS

Figure 1:
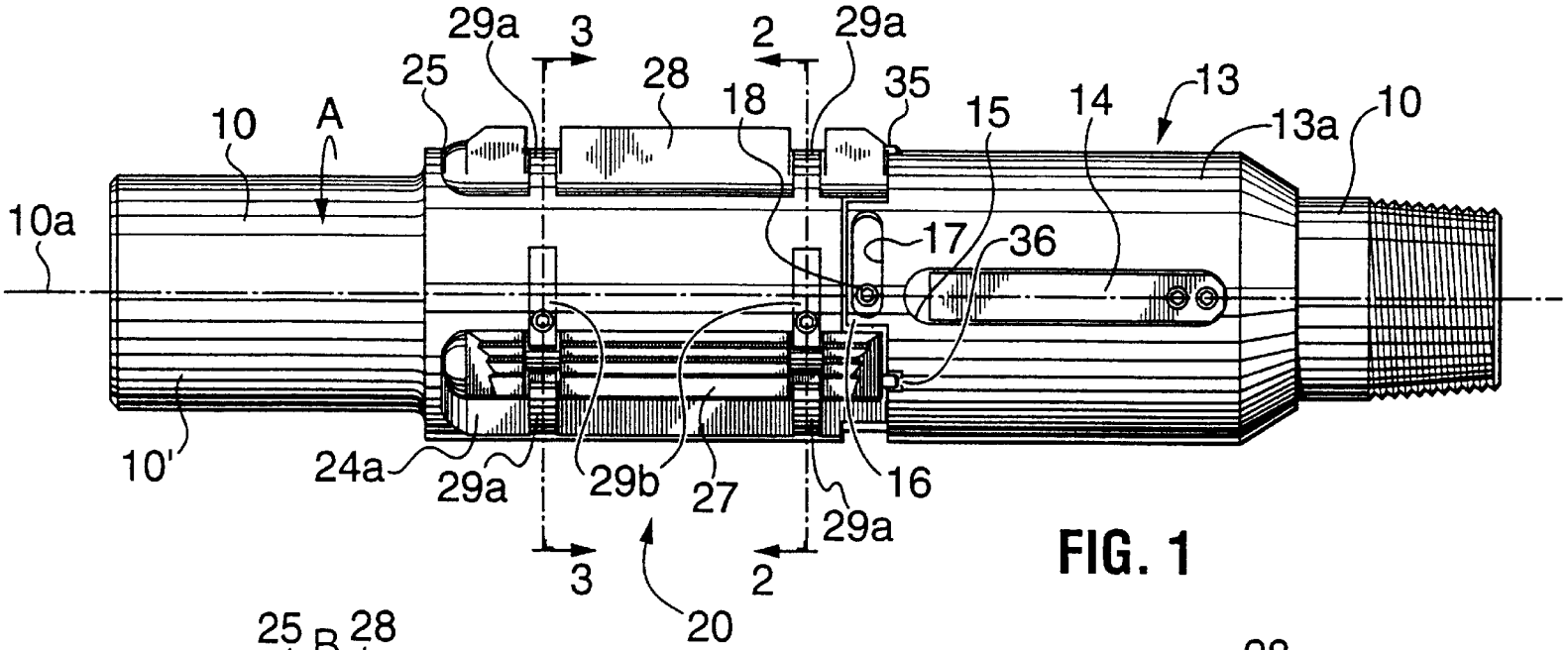
FIG. 1 is a front elevation of an anchor of the present invention.
Figure 3:
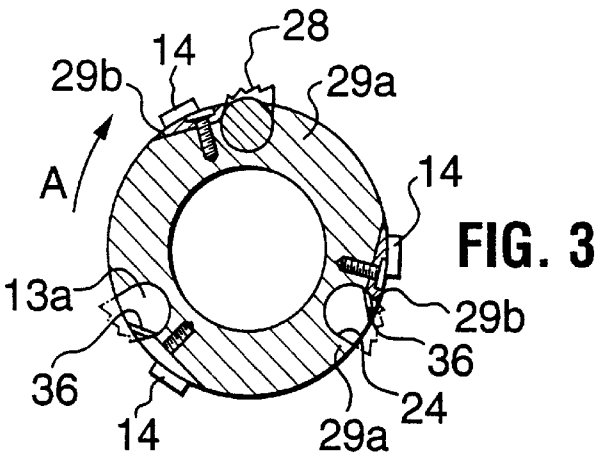
FIG. 3 is a view along line 3—3 of FIG. 1 with only one slip member in position.
Figure 2:
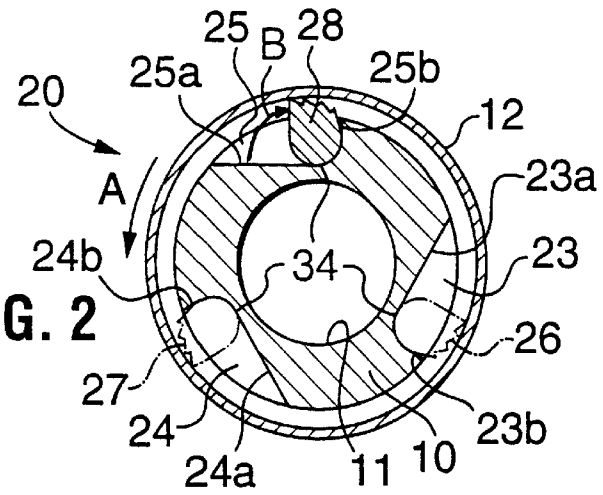
FIG. 2 is a view along line 2—2 of FIG. 1 with the anchor shown in relation to a segment of well casing.

Referring to FIGS. 1, 2 and 3, the anchor has a piece of tubing 10 with a bore 11 through it for oil to pass upwardly. The tubing 10 is of small enough outer diameter to provide an annulus between the tubing and the casing 12 of the well.

On the exterior of the tubing 10 is mounted a drag assembly indicated generally as 13. The drag assembly includes a cylindrical housing 13*a* disposed about tubing 10. Belly springs 14 are mounted in recesses 15 formed in the surface of housing 13*a*. In an alternate embodiment, drag blocks and drag block springs are used, as is known. The function of either the drag block or the belly spring is to provide the drag housing with some resistance to rotational movement, although the resistance is slight and can relatively easily be overcome. Thus, the drag block or belly spring biases against the casing when the tubing is raised or lowered within the casing, but does not bias sufficiently strongly to prevent such raising or lowering. It also resists rotation of the tubing, but not enough to prevent such rotation.

A portion 16 of housing 13*a* extends out and has formed therein a slot 17. A bolt 18 is secured to tubing 10 through slot 17. Drag assembly 13 is attached to tubing 10 by means of the head of bolt 18 engaging against the edges of slot 17. However, drag assembly 13 can rotate about tubing 10.

Adjacent to drag assembly 13, in an upward direction as the tubing would be oriented in a well, is the slip assembly 20. Slip assembly 20 includes three elongate recesses 23, 24 and 25 formed in the outer surface of tubing 10. Each recess is generally U-shaped with one sloped side, as shown at 23*a*, 24*a* and 25*a*, and one generally upstanding side 23*b*, 24*b*, 25*b*. The slopes are formed on the same sides of the recesses.

Retained in recesses 23, 24 and 25 are slip members 26, 27, 28. These are mounted so as to be pivotal about their long axes, which are substantially parallel to the long axis 10*a* of tubing 10. The slip members can rotate through an arc to abut against sloped side 23*a*, 24*a*, 25*a* and upstanding side 23*b*, 24*b*, 25*b*. Slip members 26, 27, 28 are retained in place by keepers 29*a*, 29*b* which extend out into the openings of the recesses. Keepers 29*a* extend from sloped sides 23*a*, 24*a*, 25*a* while keepers 29*b* are secured adjacent sides 23*b*, 24*b*, 25*b*. In the preferred embodiment, keepers 29*a* extend a selected distance over the surface of recesses to prevent slip members 26, 27, 28 from being forced out of the recesses by over centring.

Figure 4B:
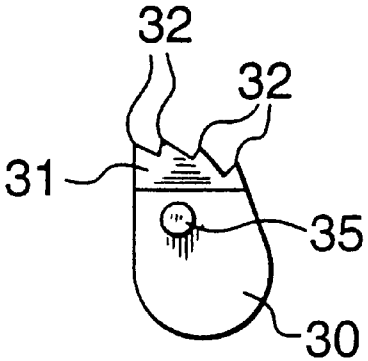
FIGS. 4A, 4B and 4C are front elevation, end elevation and top plan views, respectively, of a slip member.
Figure 4A:
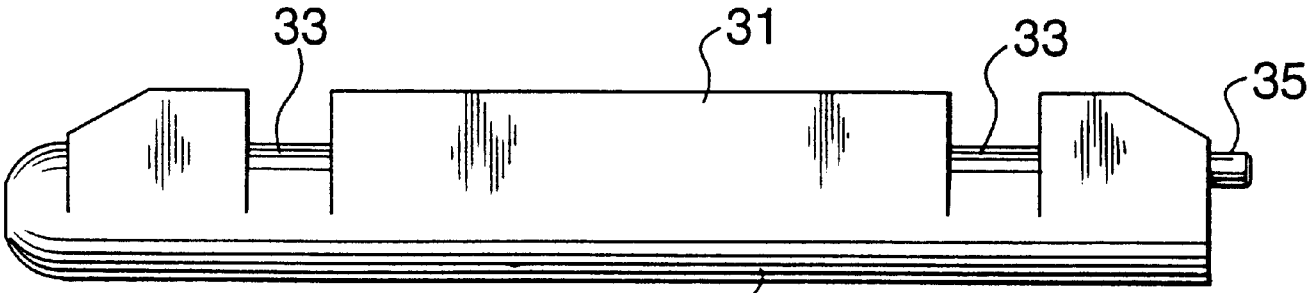
Figure 4C:
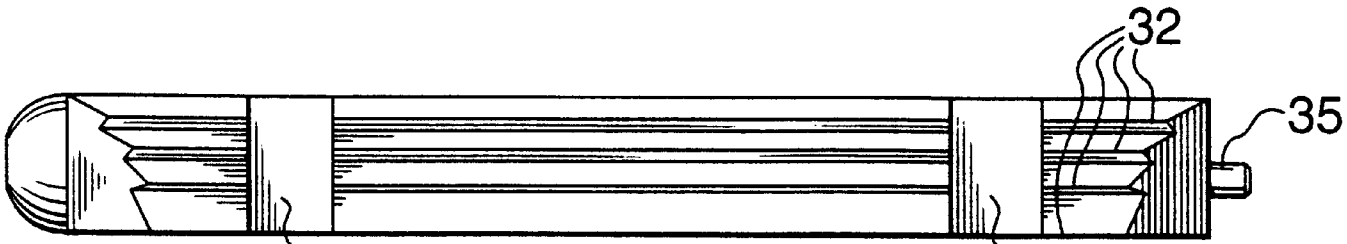
Figure 5A:
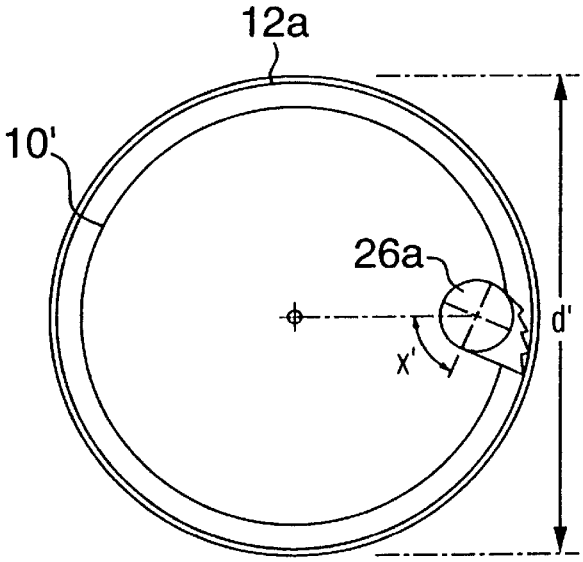
Figure 5A:
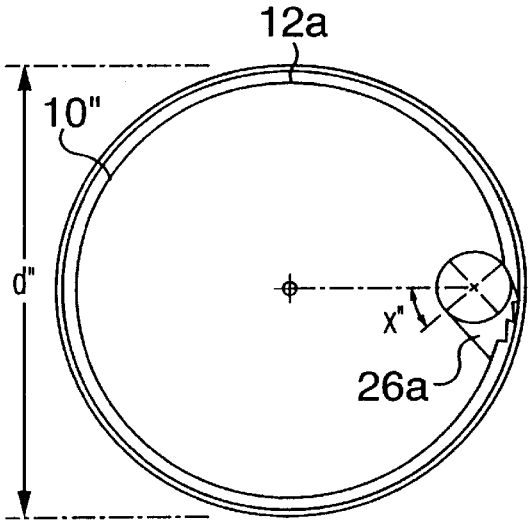

The slip members 26, 27, 28 each have a larger cylindrical base portion 30 and an outer edge portion 31 (see FIGS. 4A to 4C). The outer edge portion has serrations 32 which engage with the casing wall 12. Portion 31 and serrations 32 are absent at two positions 33 along the members to allow for placement of keepers 29*a*, 29*b*. The slip members are circular in cross section at portions 33 to allow for rotation beneath keepers 29*a*, 29*b*. Serrations are formed with a cutting edge which will bite into casing steel. With reference also to FIGS. 5A and 5B, preferably the tips of serrations 32 are stepped such that at least some of the serrations will engage with the casing wall regardless of the degree of rotation of the slip members. This permits an anchor to be used in a range of well casing diameters. For example, FIG. 5A shows an anchor having a slip member 26*a* in a casing 12*a* having a diameter d'. Slip member 26*a* is rotated at an angle x' from perpendicular. FIG. 5B shows the anchor in a casing 12*b* having a larger diameter d" than that shown in FIG. 5A. Slip member 26*a* is rotated at a angle x", which is less than that of x'. In each case two serrations are in contact with the casing.

The slip members contact the recesses at contact area 34. Recesses 23, 24, 25, substantially conform to the shape of the cylindrical base portion 30 to enhance transmission of forces to the tubing and to provide support for the slip members.

Figure 6:
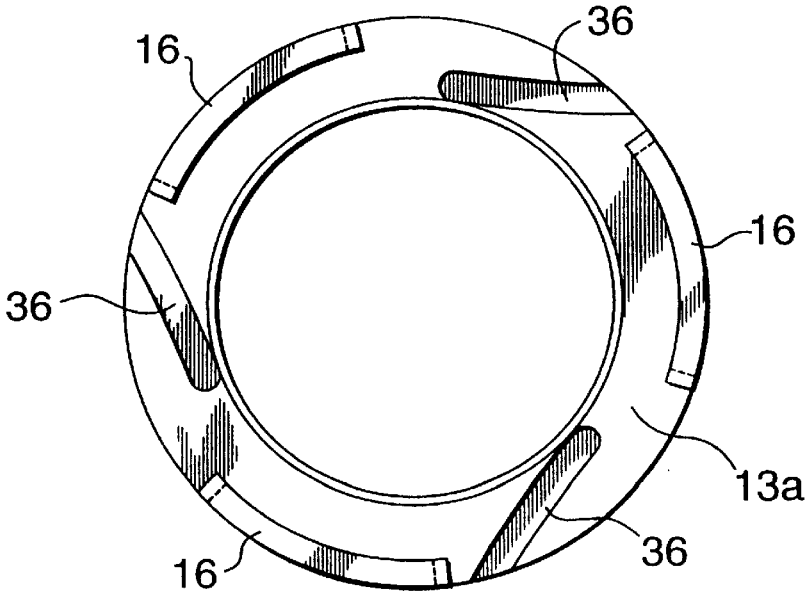
FIG. 6 is an end elevation of the drag housing of FIG. 1.

Slip members 26, 27, 28 each have a cylindrical pin 35 extending from their lower ends. In this embodiment, pin 35 is offset from the axes of rotation of members 26, 27, 28. Referring to FIGS. 1, 3 and 6, each pin 35 registers with a groove 36 formed in the end face of drag housing 13*a*. Grooves 36 spiral inwardly from the outer edges of the end face toward the centre. The pins ride in the grooves and move in response to rotational movement of the drag housing relative to the tubing 10. As pins 35 ride along the groove this drives the rotation of the slip members within the recesses. While the grooves are shown arched, it is to be understood that grooves can be linear.

In use, the anchor is inserted into the well to prevent rotation of a member, such as a tubing string or pump within the well. The anchor as shown in the drawings is attached such that end 10' is uppermost. End 10' can be, for example threadably engaged to a pump, not shown, and the opposite end is attached to the upper end of a tubing string, also not shown.

When the anchor is raised and lowered in the well, the slip members are in the retracted position in which slip members 26, 27, 28 rest against the sloped sides 23*a*, 24*a*, 25*a* of the recesses and pins 35 are at the inner end of grooves 36. In this position, the serrations do not touch the casing. However, when the anchor is in place, and the screw pump is started, rotational torque is imparted to tubing 10 which causes it to turn within the casing. The anchor shown in the Figures is intended to be used against torque which causes the tubing to turn in the direction as shown by arrows A. The belly springs 14, or the equivalent drag blocks, which are always in contact with the casing, provide a certain measure of drag against such rotation, although their force is not strong enough to prevent it. As the drag assembly is initially prevented from turning with the tubing 10, the tubing rotates within the drag assembly 13. As tubing 10 rotates within drag housing 13*a*, pins 35 ride out along grooves 36 and thereby cause slip members 23, 24, 25 to rotate in a direction as shown by arrow B, which is opposite to direction A, to an extended position until portion 31 contacts the casing and serrations 32 bite into the casing. The slip members wedge between the tubing and the casing and this effectively prevents further turning of the tubing 10.

When it is desired to permit movement of the tubing 10 relative to the casing, the tubing is rotated in the opposite direction to that of arrows A. This causes outer edge portions 31 to again lie against sloped sides 23*a*, 24*a*, 25*a* so that the slip members no longer oppose rotation.

Figure 7:
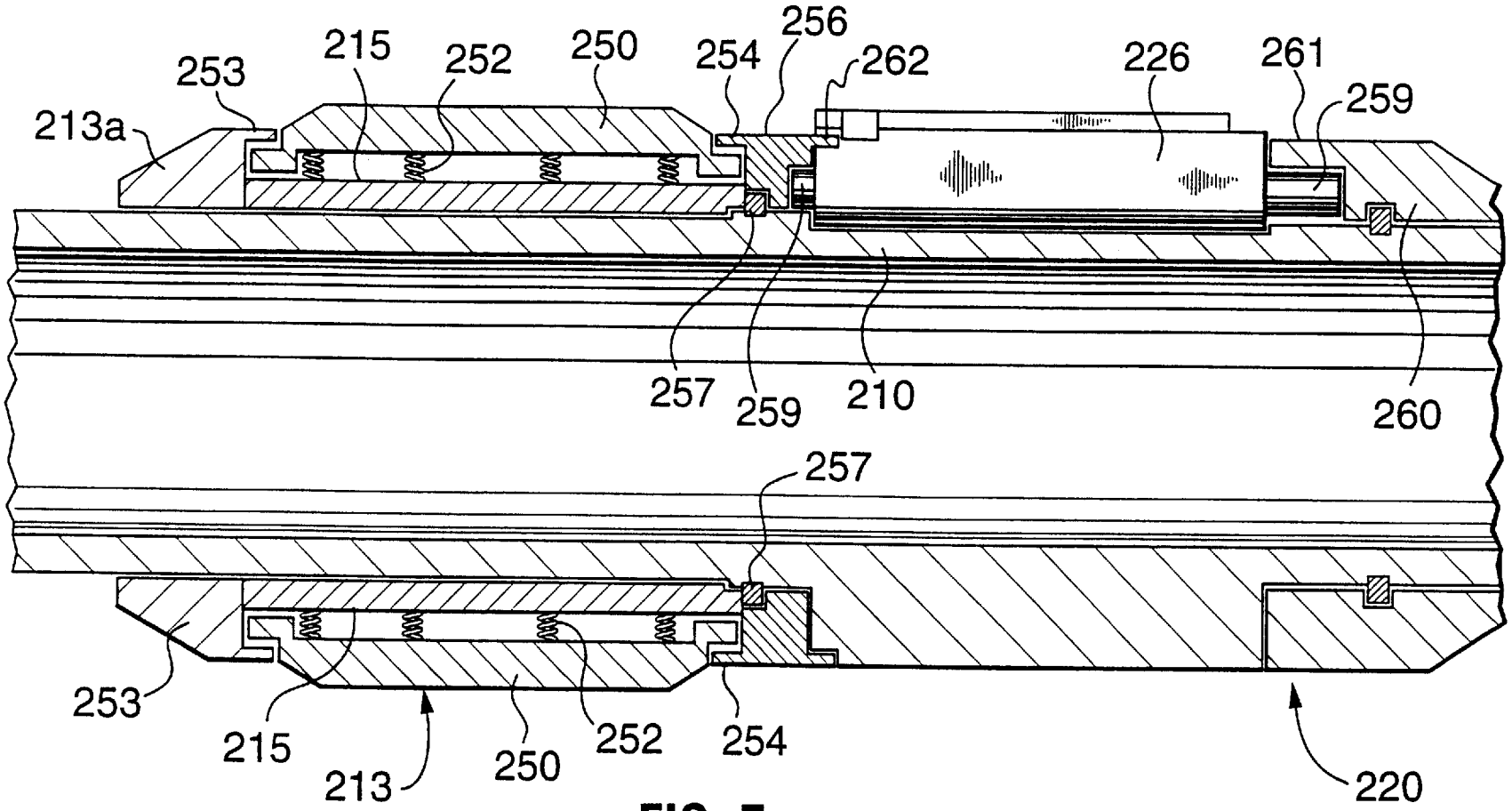
FIG. 7 is a sectional view along another embodiment of an anchor of the present invention.

Referring to FIG. 7, another embodiment of the anchor is shown which includes tubing 210, a drag assembly 213 and a slip assembly 220. The drag assembly includes a cylindrical housing 213*a* in which drag blocks 250 are mounted. Drag blocks 250 are retained in recesses 215 formed in the housing 213*a*. Drag block springs 252 urge drag blocks 250 outwardly into contact with lower retaining flange 253 and upper retaining flange 254. Upper retaining flange 254 is formed integral with an actuating ring 256. Ring 256 is engaged to drag housing 213*a* and fits loosely over tubing 210, so it can rotate with drag housing 213*a* about tubing 210. A retaining ring 257 maintains ring 256 in position along the length of tubing 210.

Slip assembly includes a housing 260 fixedly mounted on tubing 210. Slip members 226 (only one can be seen) are mounted in housing 260 and rotate about their axles 259 between a retracted position and an extended position, as discussed hereinbefore. A retaining wall 261, formed integral with housing 260 retains slip members 226 at their upper end and actuating ring 256 retains them at their lower end. Ring 256 has protrusions 262 which extend out to contact opposing surfaces of each slip member 226. Rotation of ring 256 moves the protrusions which push the slip members between a retracted position and an extended position, as shown.

Figure 9:
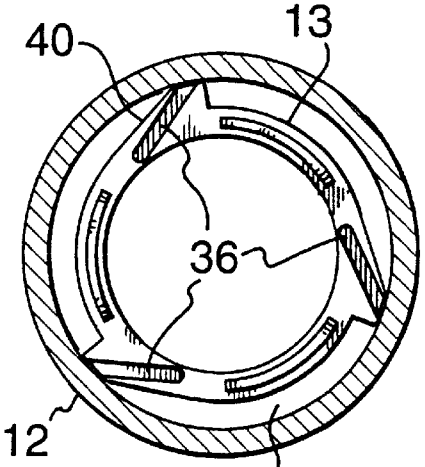
FIG. 9 is a down hole end view of the viscous drag housing in a well casing shown in cross-section.
Figure 8:
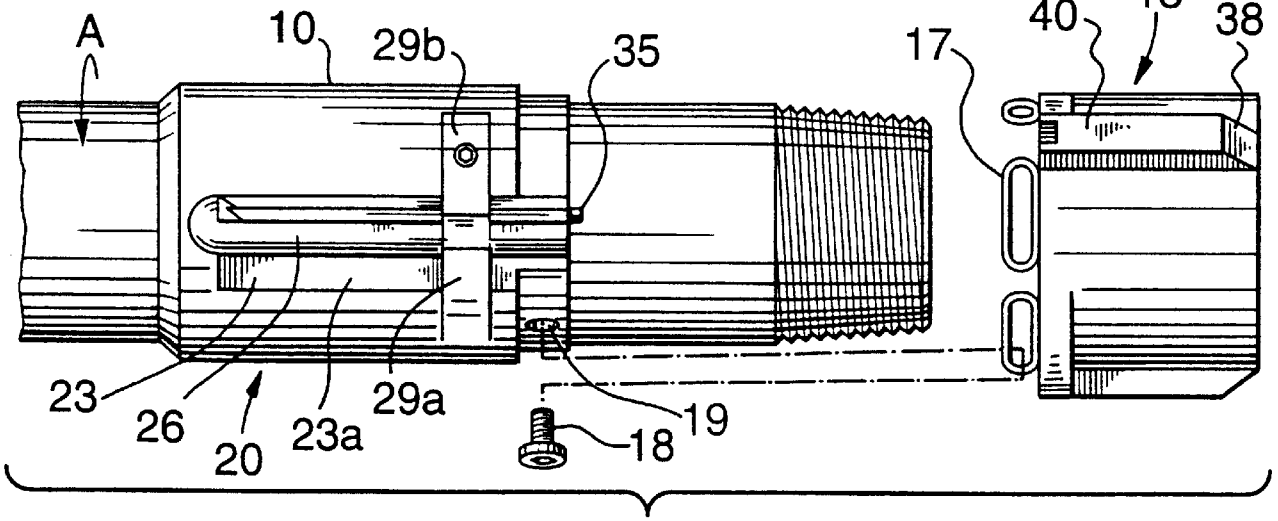
FIG. 8 is an exploded plan view of an embodiment of an anchor of the present invention with a viscous drag housing.

Referring to FIG. 8 an alternate embodiment of the anchor of the present invention is shown. The anchor is provided with a plurality of slip members 26 retained within the anchor assembly by means of keepers 29*a* and 29*b*. The slip members 26 are rotatably mounted within the slip assembly 20 to permit the slip member to rotate between a retracted position and an extended position. The slip member 26 of FIG. 8 is shown in its extended position. When in a retracted position the slip member 26 will rotate to lie in contact with the sloped side 23*a* recess to decrease the diameter of the slip assembly 20 permitting it to be slid into or out of a well casing or rotate in a limited manner within the casing 12. Shown removed from the slip assembly is the drag assembly 13 which is provided with a plurality of vanes 38 that have an outer vane surface 40 dimensioned to be slidably received within a well casing 12 but which react with a viscous fluid 42 (of FIG. 9) to introduce a drag force tending to oppose rotation between the drag assembly 13 and a well casing 12. As the drag assembly 13 is rotatably mounted on slip assembly 20, the drag forces tend to cause the drag assembly 13 to rotate with respect to the slip assembly 20. The amount of rotation permitted between the drag assembly 13 and the slip assembly 20 is limited by slots 17 provided in the end portion of the drag assembly 13 which are dimensioned to slidably receive bolt 18 therein. Bolt 18 is threaded into a threaded receiving bore 19 provided on the slip assembly 20.

Rotation of the drag assembly 13 with respect to the slip assembly causes the slip members 26 to move into an extended position through operation of pin 35 which is constrained to move along the path of groove 36 of the drag assembly.

When the anchor assembly moves or rotates in the direction depicted by arrow A of FIG. 8, as for example due to coupled reaction forces on the anchor caused by operation of a pump, drag forces between drag assembly 13 and the interior surface of well casing 12 will cause drag assembly 13 to rotate with respect to slip assembly 20 whereby pin 35 will move along groove 36 to extend slip members 26 outwardly to frictionally engage the interior surface of the well casing 12. As a result, the anchor of the present invention will stop further rotation between the slip assembly 20 and the well casing 12. Conversely, when the torque is applied to tubing 10 to cause the slip assembly 20 to rotate in the direction opposite that depicted by arrow A the drag forces acting on the drag assembly 13 will cause the slip members 26 to retract inwardly to coextend within recess 23 thereby releasing the anchor of the present invention from engagement with the casing 12.

Figure 10B:
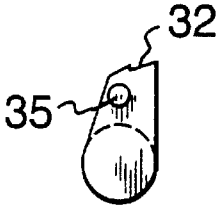
FIGS. 10, 10*a* and 10*b* are front elevation and opposing end views of an alternative embodiment of a slip member in accordance with the present invention.
Figure 10:
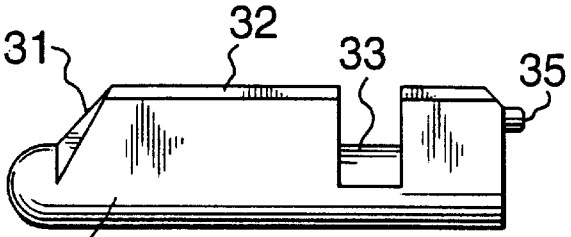
Figure 10A:
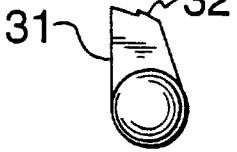

Referring to FIGS. 10 and 10*b*, there is shown an alternate embodiment of a slip member 26 of the present invention. In accordance with this embodiment of the invention, the slip member 26 is provided with a single serration absent location 33. The outer extent of outer edge portion 31 of the slip member is provided with a plurality of serrations 32 for positive frictional engagement of the interior surface of a well casing 12.

It will be apparent that many changes may be made to the illustrative embodiments, while falling within the scope of the invention and it is intended that all such changes be covered by the claims appended hereto.

I claim:

1. A downhole tool for preventing rotational movement of a member within a well, having an inner well wall, the down hole tool comprising:

an elongate tubular member having a central axis;

a slip housing disposed about the tubular member and carrying at least two slip members, the slip members each being rotatable about an axis substantially parallel to the central axis of the tubular member between a retracted position in which the slip members are out of contact with the inner well wall, and an extended position in which the slip members engage the inner well wall;

a drag housing carrying drag means and being mounted on and rotatable about the tubular member; and an actuator acting between the drag housing and the slip members to drive the rotation of the slip members in response to the rotation of the tubular member within the drag housing.

2. The downhole tool as claimed in claim 1 wherein the slip housing is formed integral with the tubular member.

3. The downhole tool as claimed in claim 1 wherein the slip members are mounted in recesses in the housing.

4. The downhole tool as claimed in claim 3 wherein the at least two slip members are each elongate having a substantially cylindrical base portion and an extension extending from the cylindrical base portion, the extension tapering towards its outer end.

5. The down hole tool as claimed in claim 4 wherein the recesses have formed therein a contact area formed to conform to the shape of the base portion.

6. The downhole tool as claimed in claim 1 wherein the rotation of the tubular member is in a first direction and the rotation of the slip members is selected to be in a direction opposite to the first direction.

7. The downhole tool as claimed in claim 1 wherein there is an actuator for each slip member.

8. The downhole tool as claimed in claim 1, each slip member having an end adjacent the drag housing and wherein the slip housing is secured to the tubular member to rotate therewith and at least one of the actuators comprises a pin extending out from the end of one of the slip members towards the drag housing and into a groove formed on the drag housing, the groove being formed to drive the rotation of the slip member by the rotation of the tubular member within the drag housing.

9. The downhole tool as claimed in claim 8 wherein the groove extends on an end face of the drag housing, the end face having an inner diameter and an outer diameter and the groove extending on the end face from a first position adjacent the outer diameter of the end face to a second position circumferentially spaced from the first position and adjacent the inner diameter of the end face and the pin being offset from the axis of rotation of the slip member.

10. The down hole tool as claimed in claim 1 wherein said drag means are operable by frictional engagement with the inner well wall.

11. The down hole tool as claimed in claim 1 wherein said drag means are operable by viscous fluid.

12. The downhole tool as claimed in claim 1 wherein the at least two slip members each have serrations formed thereon for biting into the inner well wall.

13. The down hole tool as claimed in claim 12 wherein the serrations are stepped.

14. The downhole tool as claimed in claim 1 wherein the at least two slip members are each elongate having a substantially cylindrical base portion and an extension extending from the cylindrical base portion, the extension tapering towards its outer end.

15. The downhole tool as claimed in claim 14 wherein the at least two slip members each have serrations formed on their extensions for biting into the inner well wall.

16. A downhole tool for preventing rotational movement of a member within a well comprising:

an elongate tubular member having a central axis;

a slip housing disposed about the tubular member and carrying at least two slip members, the slip members each being rotatable about an axis substantially parallel to the central axis of the tubular member between a retracted position and an extended, anchoring position;

a drag housing carrying drag means and being mounted on and rotatable about the tubular member; and an actuator to drive the rotation of the slip members in response to the rotation of the tubular member within the drag housing, there being no springs acting against the slip members to drive their movement.

17. The downhole tool as claimed in claim 16 wherein the slip housing is formed integral with the tubular member.

18. The downhole tool as claimed in claim 16 which the slip members are mounted in recesses in the housing.

19. The downhole tool as claimed in claim 18 wherein the at least two slip members are each elongate having a substantially cylindrical base portion and an extension extending from the cylindrical base portion, the extension tapering towards its outer end.

20. The down hole tool as claimed in claim 19 wherein the recesses have formed therein a contact area formed to conform to the shape of the base portion.

21. The downhole tool as claimed in claim 16, each slip member having an end adjacent the drag housing and wherein the slip housing is secured to the tubular member to rotate therewith and at least one of the actuators includes a pin extending out from the end of one of the slip members towards the drag housing and into a groove formed on the drag housing, the groove being formed to drive the rotation of the slip member by the rotation of the tubular member within the drag housing.

22. The downhole tool as claimed in claim 21 wherein the groove extends on an end face of the drag housing, the end face having an inner diameter and an outer diameter and the groove extending on the end face from a first position adjacent the outer diameter of the end face to a second position circumferentially spaced from the first position and adjacent the inner diameter of the end face and the pin being offset from the axis of rotation of the slip member.

23. The downhole tool as claimed in claim 16 wherein the at least two slip members each have serrations formed thereon for biting into the inner well wall.

24. The down hole tool as claimed in claim 23 wherein the serrations are stepped.

25. The downhole tool as claimed in claim 16 wherein the at least two slip members are each elongate having a substantially cylindrical base portion and an extension extending from the cylindrical base portion, the extension tapering towards its outer end.

26. The downhole tool as claimed in claim 25 wherein the at least two slip members each have serrations formed on their extensions for biting into the inner well wall.

27. The down hole tool as claimed in claim 16 wherein said drag means are operable by frictional engagement with a well casing.

28. The down hole tool as claimed in claim 16 wherein said drag means are operable by viscous fluid.

* * * * *